US010587949B1

(12) United States Patent
Hagman

(10) Patent No.: US 10,587,949 B1
(45) Date of Patent: Mar. 10, 2020

(54) ACOUSTICALLY TUNED FACE PANEL FOR SPEAKER SYSTEM

(71) Applicant: Paul N. Hagman, Mount Vernon, WA (US)

(72) Inventor: Paul N. Hagman, Mount Vernon, WA (US)

( * ) Notice: Subject to any disclaimer, the term of this patent is extended or adjusted under 35 U.S.C. 154(b) by 0 days.

(21) Appl. No.: 16/368,721

(22) Filed: Mar. 28, 2019

Related U.S. Application Data

(60) Provisional application No. 62/649,157, filed on Mar. 28, 2018.

(51) Int. Cl.
*H04R 1/02* (2006.01)
*H04R 1/28* (2006.01)
*H04R 5/02* (2006.01)

(52) U.S. Cl.
CPC ..... *H04R 1/2873* (2013.01); *H04R 1/02* (2013.01); *H04R 1/023* (2013.01); *H04R 5/02* (2013.01); *H04R 2201/021* (2013.01); *H04R 2499/11* (2013.01); *H04R 2499/15* (2013.01)

(58) Field of Classification Search
CPC ..... H04R 1/023; H04R 1/24; H04R 1/2811; H04R 1/2834; H04R 7/045; H04R 2201/021; H04R 2440/07; H04R 2499/11; H04R 1/02; H04R 2499/15
USPC ..... 381/152, 182, 186, 345, 350, 351, 353, 381/386, 388, 431
See application file for complete search history.

(56) References Cited

U.S. PATENT DOCUMENTS 3,160,225 A 12/1964 Sechrist
3,164,221 A 1/1965 Rich
3,636,281 A 1/1972 Cozart
(Continued)

FOREIGN PATENT DOCUMENTS

FR 2907069 4/2008
JP 2003019900 A 1/2003
(Continued)

OTHER PUBLICATIONS

Acoustical Surfaces, Inc., "Noise S.T.O.P. Acoustimetal," Website https://www.acousticalsurfaces.com/acousti_metal/acoustimetal.html, 4 pages; accessed Jan. 23, 2018.
(Continued)

*Primary Examiner* — Huyen D Le
(74) *Attorney, Agent, or Firm* — Schacht Law Office, Inc.; Dwayne Rogge

(57) ABSTRACT

The disclosure relates to several embodiments of a speaker system, the speaker system comprising a face panel which may be formed of metals, metal composites, metal alloys, PVC, expanded PVC, hardened fibrous materials, foam core, or equivalents. The face panel of one example has an outer surface which in some embodiments is substantially coplanar with the surrounding wall section, and in other embodiments extends slightly outward therefrom. The face panel has an inner surface with a tuning pad affixed thereto. The base frame, speaker assembly, and the face panel cooperate to form an acoustic chamber that is positioned behind the inner surface of the face panel. Acoustic energy is transferred from the speaker assembly to the face panel via the acoustic chamber where the sound is produced therefrom to the room.

10 Claims, 6 Drawing Sheets

(56) References Cited

U.S. PATENT DOCUMENTS

| | | | |
|---|---|---|---|
| 3,728,497 | A | 4/1973 | Komatsu |
| 3,848,090 | A | 11/1974 | Walker |
| 3,938,617 | A | 2/1976 | Forbes |
| 3,978,941 | A | 9/1976 | Siebert |
| 4,151,971 | A | 5/1979 | Daly et al. |
| 4,329,716 | A | 5/1982 | Porco |
| 4,330,691 | A | 5/1982 | Gordon |
| 4,484,658 | A | 11/1984 | Grote |
| 4,506,117 | A | 3/1985 | Fresard |
| 4,903,300 | A | 2/1990 | Polk |
| 4,923,032 | A | 5/1990 | Nuernberger |
| 4,926,398 | A | 5/1990 | Fincher |
| 4,928,312 | A | 5/1990 | Hill |
| 4,974,698 | A | 12/1990 | Smith |
| 4,997,058 | A | 3/1991 | Bertagni |
| 5,113,968 | A | 5/1992 | Lemmon |
| 5,119,421 | A | 6/1992 | Reime |
| 5,136,549 | A | 8/1992 | Berglund |
| 5,264,765 | A | 11/1993 | Pecorino et al. |
| 5,283,835 | A | 2/1994 | Athanas |
| 5,400,412 | A | 3/1995 | King et al. |
| 5,400,413 | A | 3/1995 | Kindel |
| 5,406,531 | A | 4/1995 | Henriquez et al. |
| 5,412,162 | A | 5/1995 | Kindel |
| 5,424,107 | A | 6/1995 | Lee |
| 5,425,107 | A | 6/1995 | Bertagni et al. |
| 5,444,611 | A | 8/1995 | Woytowitz et al. |
| 5,539,835 | A | 7/1996 | Bertagni et al. |
| 5,546,469 | A | 8/1996 | Donahoe |
| 5,615,275 | A | 3/1997 | Bertagni |
| 5,693,917 | A | 12/1997 | Bertagni et al. |
| 5,991,424 | A | 11/1999 | Bertagni et al. |
| 6,056,083 | A | 5/2000 | Daniell |
| 6,154,555 | A | 11/2000 | Roark |
| 6,198,831 | B1 | 3/2001 | Azima et al. |
| 6,327,369 | B1 | 12/2001 | Azima et al. |
| 6,332,029 | B1 | 12/2001 | Azima et al. |
| 6,351,542 | B2 | 2/2002 | Azima et al. |
| 6,385,326 | B1 | 5/2002 | Peng |
| 6,396,769 | B1 | 5/2002 | Polany |
| 6,578,808 | B1 | 6/2003 | Bertagni et al. |
| 6,782,112 | B1 | 8/2004 | Geddes |
| 6,901,987 | B1 | 6/2005 | Graham |
| 6,925,191 | B2 | 8/2005 | Petroff et al. |
| 6,929,091 | B2 | 8/2005 | Bertagni et al. |
| 7,020,302 | B2 | 3/2006 | Konishi et al. |
| 7,050,600 | B2 | 5/2006 | Saiki et al. |
| 7,287,737 | B2 | 10/2007 | Rossi |
| 7,292,702 | B2 | 11/2007 | Hagman |
| 7,337,024 | B1 | 2/2008 | Graham |
| D563,804 | S | 3/2008 | Kimura et al. |
| D571,355 | S | 6/2008 | Koizumi |
| 7,409,071 | B1 | 8/2008 | Bromer |
| 7,460,679 | B2 * | 12/2008 | Itoh ..... H04R 1/021 381/182 |
| 7,502,485 | B2 * | 3/2009 | Mouri ..... H04R 1/2842 381/186 |
| D592,641 | S | 5/2009 | Ryu et al. |
| 7,543,681 | B2 | 6/2009 | Howard et al. |
| D669,469 | S | 10/2012 | Kang |
| D685,346 | S | 7/2013 | Szymanski et al. |
| D687,821 | S | 8/2013 | Lee et al. |
| D695,250 | S | 12/2013 | Kim et al. |
| 8,611,575 | B1 | 12/2013 | Hagman |
| 8,958,591 | B2 | 2/2015 | Hagman |
| 9,008,342 | B1 | 4/2015 | Hagman |
| D739,844 | S | 9/2015 | Hagman |
| 9,313,570 | B1 | 4/2016 | Hagman |
| 2002/0085733 | A1 | 7/2002 | Cottrell |
| 2003/0081800 | A1 | 5/2003 | Klasco et al. |
| 2004/0202343 | A1 | 10/2004 | Rye et al. |
| 2005/0067216 | A1 | 3/2005 | Schuhmann et al. |
| 2005/0168661 | A1 | 8/2005 | Maxson |
| 2006/0248759 | A1 | 11/2006 | Moshlak |
| 2007/0056201 | A1 | 3/2007 | Price et al. |
| 2007/0263081 | A1 | 11/2007 | De Beer et al. |
| 2007/0297637 | A1 | 12/2007 | Sugiyama et al. |
| 2008/0049400 | A1 | 2/2008 | Pecorino et al. |
| 2009/0193724 | A1 | 8/2009 | Struthers et al. |
| 2011/0157489 | A1 | 6/2011 | Ichioka et al. |
| 2012/0134518 | A1 | 5/2012 | Otani et al. |
| 2013/0022221 | A1 | 1/2013 | Kallai et al. |
| 2013/0063004 | A1 | 3/2013 | Lai et al. |
| 2013/0156243 | A1 | 6/2013 | Hagman |
| 2016/0165329 | A1 | 6/2016 | Fedyay et al. |

FOREIGN PATENT DOCUMENTS

| | | | |
|---|---|---|---|
| WO | 9628949 | A1 | 6/1996 |
| WO | 2007008014 | A1 | 1/2007 |

OTHER PUBLICATIONS

Komatex, "Technical Values.", pp. 1-2, 2007.

* cited by examiner

ACOUSTICALLY TUNED FACE PANEL FOR SPEAKER SYSTEM

RELATED APPLICATIONS

This application claims priority benefit of U.S. Provisional Ser. No. 62/649,157 filed on Mar. 28, 2018, incorporated herein by reference.

BACKGROUND OF THE DISCLOSURE

Field of the Disclosure

This disclosure relates to the field of non-permeable face panels for a speaker system including a tuning pad affixed to the rearward side of the face panel to increase sound quality.

BRIEF SUMMARY OF THE DISCLOSURE

Disclosed herein is an acoustically tuned face panel assembly for a speaker system. The panel assembly of one example comprising: a base frame having a forward side; a first speaker assembly having a forward perimeter portion fixed to the base frame; a second speaker assembly having a forward perimeter portion fixed to the base frame; a non-permeable face panel having a rearward side offset from the forward perimeter portion of the first speaker assembly and the second speaker assembly; the face panel having a rearward side of the face panel in contact with the forward side of the base frame; a first acoustic chamber defined by the rearward side of the face panel, the first speaker assembly, and a surface defining a first opening through the base frame; a second acoustic chamber defined by the rearward side of the face panel, the second speaker assembly, and a surface defining a second opening through the base frame; and a tuning pad attached to the rearward side of the face panel wherein the tuning pad extends from the first acoustic chamber to the second acoustic chamber without directly contacting the base frame.

The panel assembly may be arranged wherein the face panel comprises a metal sheet.

The panel assembly may be arranged wherein the tuning pad comprises a metal sheet.

The panel assembly may be arranged wherein the tuning pad comprises the same material as the face panel.

A sealed housing comprising at least one panel assembly as recited herein wherein the face panel forms at least one outer surface of the sealed housing.

In another example is disclosed an acoustically tuned face panel assembly for a speaker system. In one example the panel assembly comprises: a base frame having a forward side; a speaker assembly having a forward perimeter portion fixed to the base frame; a non-permeable face panel having a rearward side offset from the forward perimeter portion of the speaker assembly; the face panel having a rearward side of in contact with the forward side of the base frame; an acoustic chamber defined by the rearward side of the face panel, the speaker assembly; and a tuning pad attached to the rearward side of the face panel wherein the tuning pad is positioned forward of the speaker assembly directly contacting the base frame.

DETAILED DESCRIPTION OF THE DISCLOSURE

In the field of speaker assemblies, especially speaker assemblies with non-fluid-permeable face panels, several problems have been identified, and several solutions proposed herein. In many such speaker assemblies, a face panel is provided on the front of an enclosure or frame. The face panel is provided to protect, and in some applications visually hide the inner components including the speaker driver components from impacts, weather, fluids, and other damaging contact. These face panels in some applications are known to detract from the sound quality of the speaker assembly. Through inspiration and experimental testing, it was discovered how such face panels may provide a surface and material for detrimental vibrations. This acoustic detraction is more pronounced in some applications where interference vibrations are in the face panel. This effect may be significant when multiple speaker assemblies are mounted to or adjacent the same face panel.

To overcome this and generally improve sound quality, the tuned face paned disclosed herein has been invented, and tested with positive test results.

Figure 8:
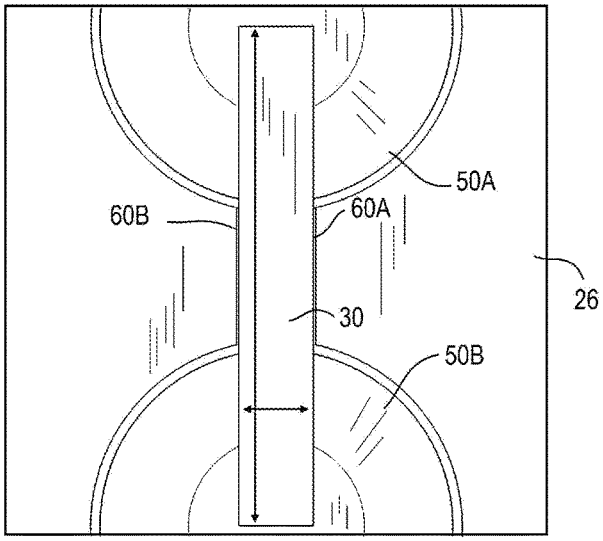
FIG. 8 is an enlarged view of the example shown in FIG. 4.
Figure 9:
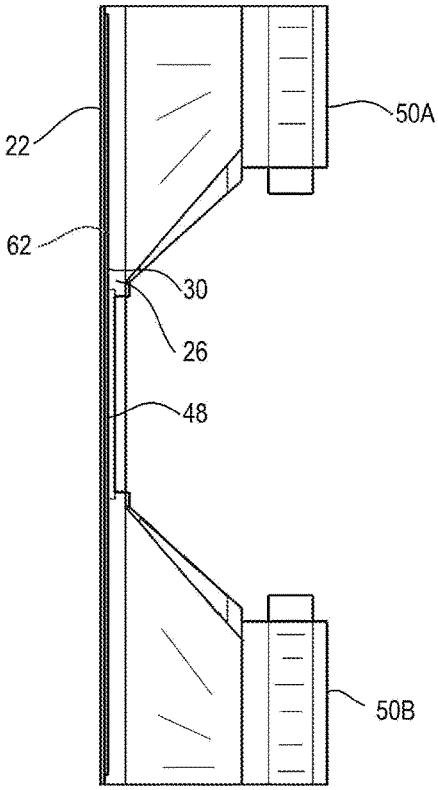
FIG. 9 is an enlarged view of the region 9 of FIG. 10.
Figure 10:
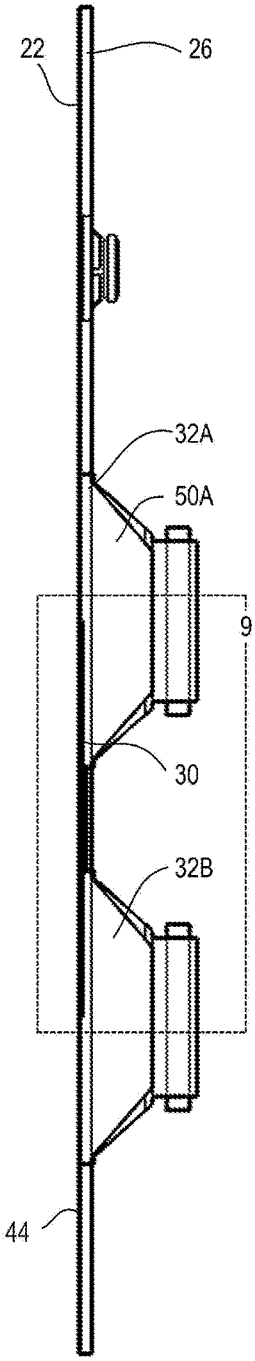
FIG. 10 is a side cutaway view taken along line 10-10 of FIG. 4.
Figure 11:
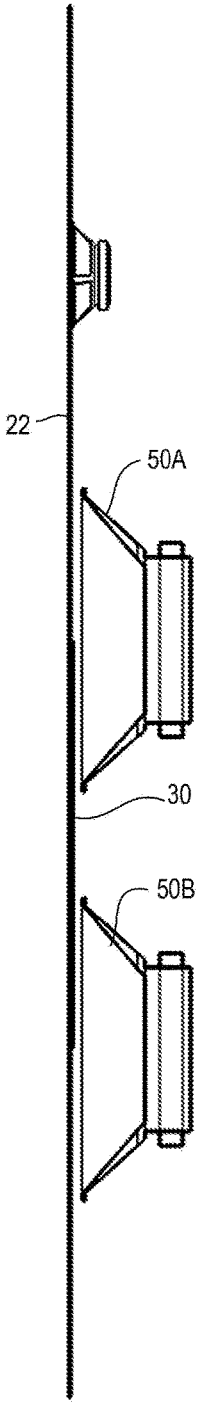
FIG. 11 is a side view of the example shown in FIG. 1 with the frame removed to show the relative position of the remaining components.

The face panel 22 disclosed herein and shown in the drawings has an inner surface 48 with an acoustic tuning pad 30. In one example, the acoustic tuning pad 30 is affixed to the transversely inner surface 48 thereof facing the speaker elements. The acoustic tuning pad 30 in one example is adapted to increase sound quality of the speaker system 20 by reducing interference vibrations of adjacent speaker assemblies 24. The tuning pad 30 in other examples may also be adapted to dampen the local vibration frequency of the face panel 22. In some installations, the tuning pad 30 is adapted to locally stiffen the face panel 22 where the tuning pad 30 is attached. In one example, the acoustic tuning pad 30 does not directly contact the base frame 26 which may otherwise reduce the tuning or dampening effect of the tuning pad 30. Thus, the tuning pad 30 is free to move (vibrate/oscillate) with the face panel 22 without contact interference with the base frame 26, causing detrimental acoustic interference. Lateral and/or longitudinal gaps or offsets 60 (60A, 60B) are shown in the example of FIG. 8 between the acoustic tuning pad 30 and the base frame 26. Likewise, in one example a transverse gap 62 or gaps is shown in FIG. 9 between the tuning pad 30 and the base frame 26. In one example, the tuning pad 30 contacts or is adhered to the face panel 22 only and does not contact any other structure such as the speaker assemblies, frame, or housing save through the face panel 22.

Disclosed herein are several embodiments of a speaker system 20 with a face panel 22 forming an active member which oscillates (acoustically vibrates) by way of a speaker assembly 24 positioned there behind. In one example, the face panel 22 is nonpermeable (i.e. air and water impermeable). These speaker assemblies are well known in the art and may comprise components including a driver, frame, cone, (magnet, voice coil, suspension, diaphragm). To improve sound quality and provide other benefits, the speaker system 20 in the example shown has a plurality of speaker assemblies 24. These speaker assemblies 24 are shown mounted to a base frame 26 with an active member or face panel 22 in front of the speaker assemblies 24 to protect and hide the speaker assemblies from damage. The face panel may be made of various materials, for example the face panel 22 may be formed of metal, metal composites, metal alloys, PVC, hardened fibrous materials such as fiberglass or carbon fiber, or equivalents. Previous attempts at making a face panel of these materials, especially metals, proved to have significant vibration issues, degrading the sound quality significantly.

The face panel 22 of this disclosure comprises an outer or forward surface 28 which in one example is substantially coplanar (even with/lying in the same plane) with a surrounding wall section, and in other examples extends slightly outward therefrom so as to hide the speaker system 20 from view. Providing a rigid, durable, non-permeable, hidden face panel 22 increases visual appeal and security in areas where speaker systems 20 may be vandalized.

Figure 12:
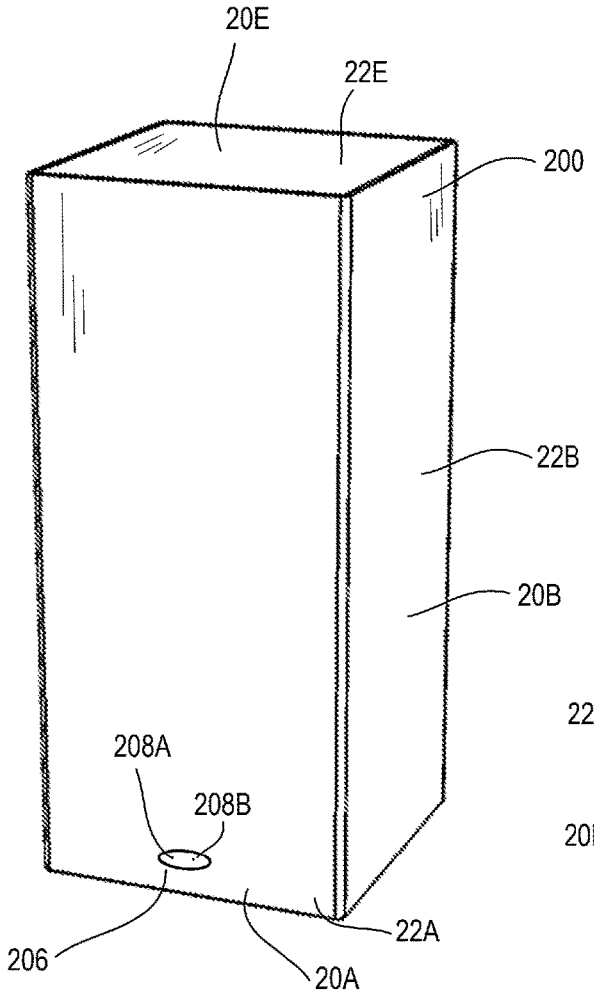
FIG. 12 is a rear perspective view of one example of a speaker enclosure utilizing the speaker system shown in FIG. 1.
Figure 13:
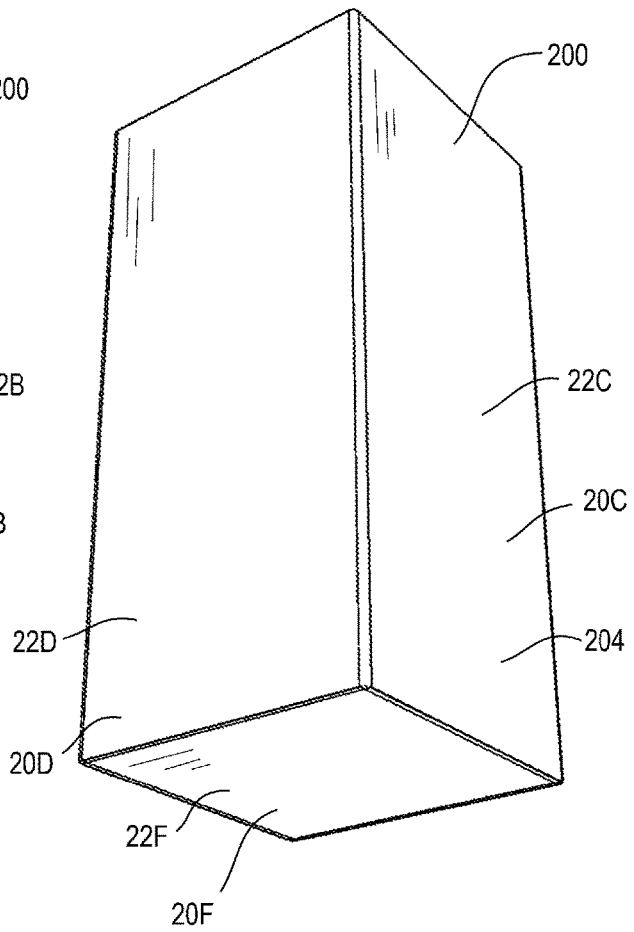
FIG. 13 is a bottom perspective view of the example speaker enclosure shown in FIG. 12.

In other examples, the face panel 22 is part of a free standing or separate enclosure as shown in FIG. 12 and FIG. 13 housing the acoustic components disclosed herein. The acoustic components may include a power supply (e.g. batteries) or other connection to a power supply. Some form of audio signal is also implemented. The audio signal is provided as an electric oscillation that powers the speaker driver and moves to diaphragm to produce sound. The speaker driver may be driven by an external device using a wired or wireless connection to an acoustic signal device. In one example, the face panel forms part of a stand-alone speaker system. In one example the speaker system comprises an air and water impermeable housing as shown in FIG. 12 and in FIG. 13, securely enclosing the speaker elements and similar components from weather and vandalism.

An axes system 10 is used herein to aid in description of the relative positioning of components. In the Figures, a longitudinal axis 12 is shown, as well as a lateral axis 14 orthogonal to the longitudinal axis 12. A transverse axis 16 is also shown orthogonal to each of the longitudinal axis 12 and lateral axis 14.

A labeling system is used in this disclosure to aid in description. The labeling system comprising a numeric identifier for general components, where in some cases the numeric identifier is followed by an alpha suffix denoting particular components. For example, low frequency element 50A is a particular example of a general low frequency element 50.

In one example, as shown in FIG. 9, the face panel 22 has an inner surface 48 with an acoustic tuning pad 30 affixed to the transversely inner surface 48 thereof facing the speaker elements. The acoustic tuning pad 30 in one example is adapted to increase sound quality of the speaker system 20 by reducing interference vibrations of adjacent speaker assemblies 24. The tuning pad 30 in other examples may also be adapted to dampen the local vibration frequency of the face panel 22. In some installations, the tuning pad 30 is adapted to locally stiffen the face panel 22 where the tuning pad 30 is there attached. In one example, the acoustic tuning pad 30 does not directly contact the base frame 26 which may otherwise reduce the tuning or dampening effect of the tuning pad 30. Thus, the tuning pad 30 is free to move (vibrate/oscillate) with the face panel 22 without contact interference with the base frame 26. Lateral and/or longitudinal gaps or offsets 60 (60A, 60B) are shown in the example of FIG. 8 between the acoustic tuning pad 30 and the base frame 26. Likewise, in one example a transverse gap 62 or gaps is shown in FIG. 9 between the tuning pad 30 and the base frame 26.

The disclosed tuning pads 30 are selected and installed to overcome deficiencies otherwise present in the interference region 100 of the face panel 22. To accomplish this, the tuning pads 30 may vary in thickness, position, and size to tune the face panel 22 dependent upon the size of the speaker assembly, the size, shape, and material of the face panel, the volume and shape of the acoustic chamber(s) 32, and the overall shape and size of the housing.

The face panels 22, and tuning pads 30 may be made of metals, metal composites, metal alloys etc., or may be made of other materials including hardened carbon fiber, hardened fiberglass, wood, polymers, etc. In one example, metals are chosen due to their durability and strength in adverse conditions.

The base frame 26, speaker assembly 24, and the inner surface of the face panel 22 cooperate to form an acoustic chamber 32. The air or other gas in the acoustic chamber 32 compresses and expands as the reciprocating portion 34 of the speaker assembly 24 vibrates in response to an electric signal received by a driver portion 36 of the speaker assembly 24. In many applications, a permanent magnet 38 forms a part of the speaker assembly 24 in a manner known in the art. Regarding the low frequency elements 50, acoustic energy is transferred through compression of the air in the acoustic chamber 32 from the speaker assembly 24 to the face panel 22 the sound is projected from the face panel 22.

In one example, the tuning pad 30 bridges between adjacent acoustic chambers 32, thus more significantly reducing interference vibrations in the interference region 100 of the face panel 22 there between. To facilitate incorporation of the tuning pad 30, surfaces defining a recessed channel 51' may be formed in the base frame 26, or a channel 51 in the face panel 22. The channel 51' extending transversely into the forward surface of the base frame 26 adjacent to the rear surface of the face panel 22. The channel 51' in one example being larger laterally 14 and transversely 16 than the tuning pad 30 to allow movement of the tuning pad 30 without the tuning pad 30 directly contacting the base frame 26. Testing has proven the concept that contact between the tuning pad 30 and the base frame 26 may be detrimental to operation of the apparatus.

In one example, the base frame 26 comprises a perimeter frame and a rear baffle. In another example these components may be constructed of a unitary structure and will be so described here forth as the base frame 26. In one example, the base frame 26 is cast (machined) from a polymeric material providing structural rigidity, ease in manufacture, cost savings, and long life when exposed to heat and weather. Alternatively, the base frame 26 may comprise at least one opening 40 (40A and 40B in the example shown in FIG. 3, 6) each opening having a perimeter surface 42 (42A, 42B) that is adapted to support the speaker assembly 24. In one example the perimeter edge of each speaker assembly 24 is mounted to the base frame 26 transversely offset from the front surface 44 of the base frame 26 so as to form the acoustic chamber 32 previously discussed. The base frame 26 further has a forward surface 44 that is adapted to mount adjacent to or in contact with the rear surface 46 of the face panel 22 described further below. In one example, a volume of adhesive 64 is applied between the base frame 26 and the face panel 22 to secure the components together. In another example, the low frequency elements 50 of the speaker assemblies 24 are mounted in a recess of the base frame 26 or to the rearward side of the base frame 26. In such an example, the base frame 26 has a longitudinal thickness adapted to define a proper spacing between the forward surface 42 of the low frequency system 50 including low frequency speaker elements 50A and 50B and the inner surface 48 of the face panel 22. The significance of the spacing and the resultant acoustic chamber 32 is described further below.

Figure 1:
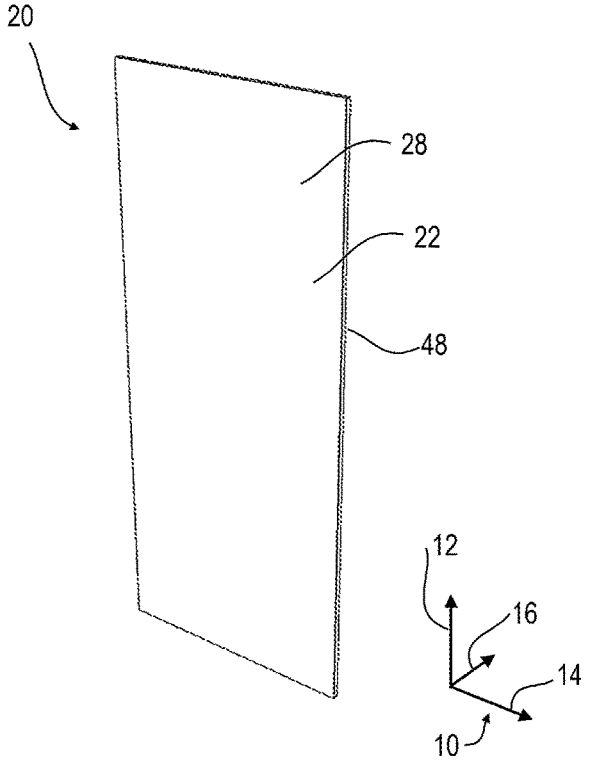
FIG. 1 is a front perspective view of one example a speaker system with an acoustically tuned face panel.
Figure 2:
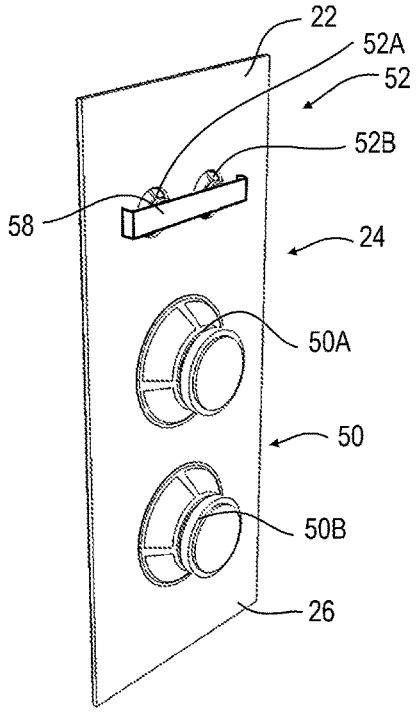
FIG. 2 is a rear perspective view of the example shown in FIG. 1.
Figure 3:
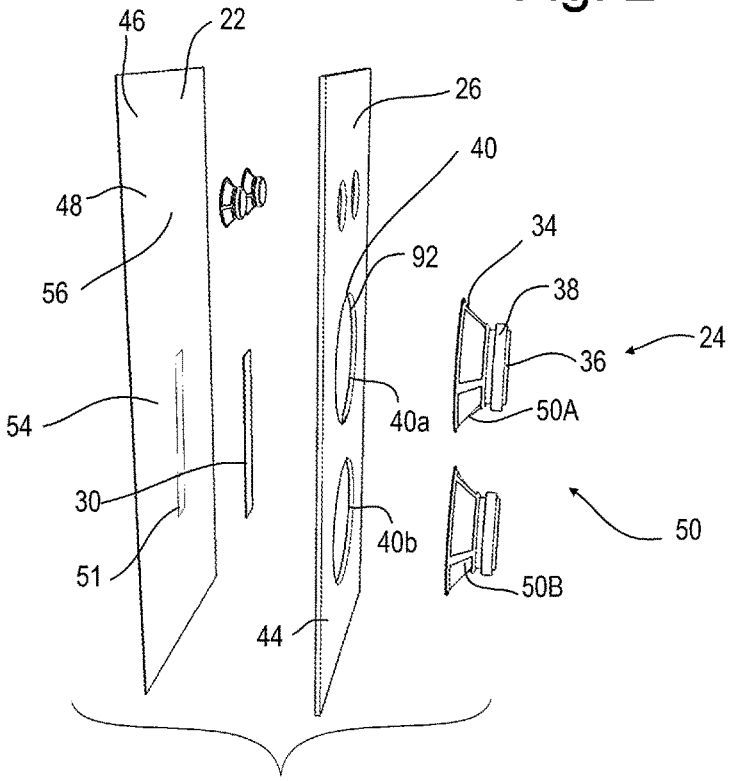
FIG. 3 is a side exploded view of the example shown in FIG. 1.
Figure 4:
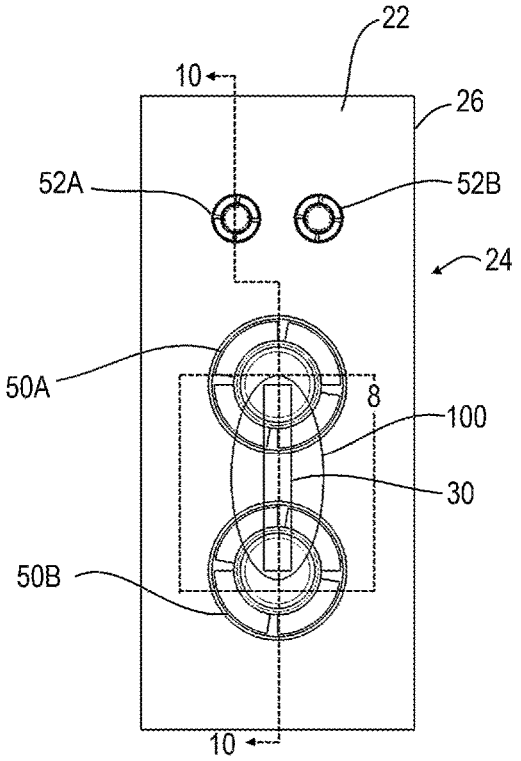
FIG. 4 is a front hidden line view of the example shown in FIG. 1.
Figure 5:
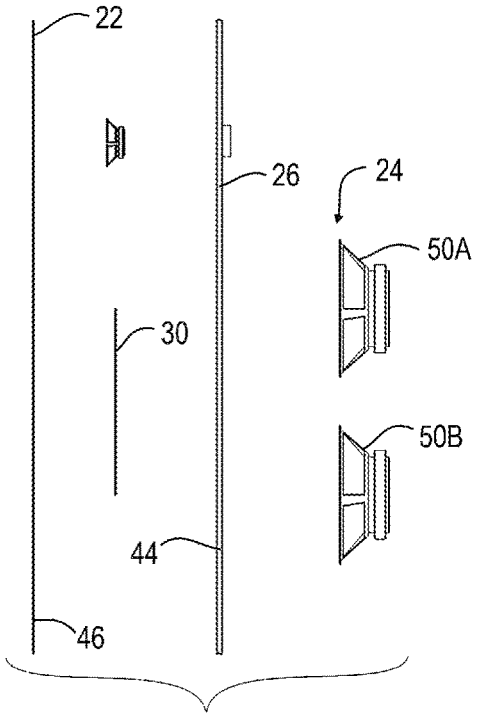
FIG. 5 is a side exploded side view of the example shown in FIG. 1.
Figure 6:
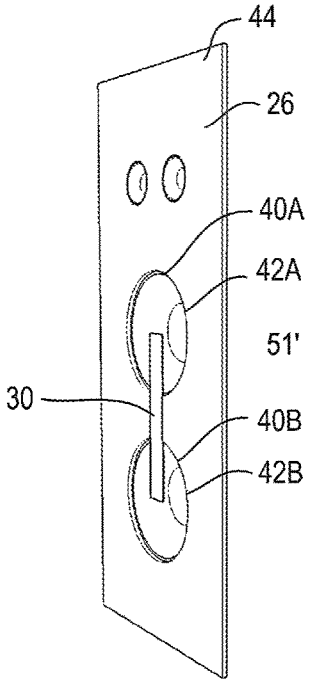
FIG. 6 is a side perspective view of the example shown in FIG. 1.
Figure 7:
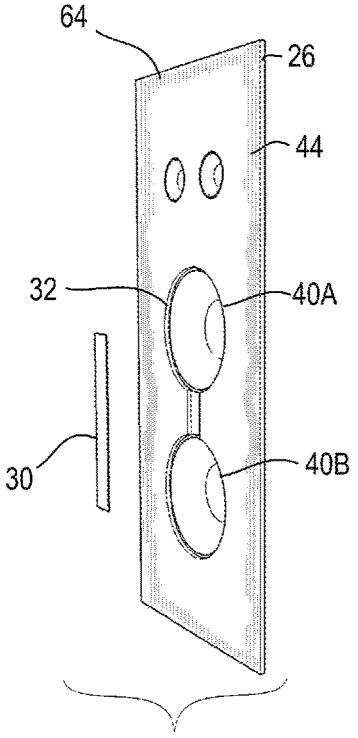
FIG. 7 is a partially exploded side view of the example shown in FIG. 1 with the face panel removed to show the components attached to the rear side thereof.

One example of the speaker system 20 also utilizes a high-frequency system 52 including high frequency elements 52A, 52B cooperating with the low frequency elements. As shown in FIG. 3, the face panel 22 has an inner surface 48 and the forward surface 28 (also referred to as the outer surface). As shown in FIG. 5, the inner surface 48 in this embodiment has a low-frequency-reciprocating region 54 forward of at least one low frequency element 50 and a high-frequency-reciprocating region 56 forward of and in contact with at least one high frequency element. The high-frequency-reciprocating region 56 interoperates with a portion of the high-frequency system 52 along with the high frequency elements 52A, 52B. The face panel 22 in one example comprises the low-frequency reciprocating region 54 oscillating as a result of air compression within the chamber(s) 32 as low frequency elements 52A, 52B move. The face panel 22 in one example comprises the high-frequency reciprocating area 56 oscillating in response to the high-frequency elements 52A and 52B.

The low-frequency reciprocating area 54 is an area of the face panel 22 that vibrates to produce lower frequency sounds adjacent the low frequency element(s) 50. This low-frequency reciprocating area 54 can overlap the high-frequency region 56 where the higher frequency vibrations vibrate with the lower frequency vibrations. In one example, while the face panel 22 is vibrating to produce lower frequency sound in the low-frequency region 54, the high-frequency region 56 of the face panel 22 can be vibrating at a higher frequency to produce additional sound vibrations. Generally, this can be accomplished without negatively affecting the low frequency region.

Because the high frequency vibrations generally have less travel in the transverse direction (amplitude), the high-frequency reciprocating area 56 in one example can be of a much smaller relative surface area across the face panel 22 than the low-frequency reciprocating area 54. For example, as shown in FIG. 3, the driver portions of the high-frequency elements 50 create a localized high-frequency reciprocating area 56. In one example the rearward portions 58 of the high frequency elements 50 are attached to the base frame 26 and extend toward the inner surface 48 of the face panel 22. In one example the high frequency elements 50 are attached via adhesive or other methods to the inner surface 48 of the face panel 22.

The face panel 22 in one example comprises a metal, a metallic composite, or a metallic alloy. The term metal will be used henceforth to cover each of these, and equivalents. In other examples the face panel 22 is formed of PVC, hardened fibrous materials such as fiberglass or carbon fiber, or equivalents. The face panel 22 layer provides the requisite rigidity and moderate flexibility to handle the acoustic coupling of the acoustic chamber 32, as well as any pressure differential, heat, cold, impact from outside objects, etc. Where the speaker system 20 is used outdoors, the need for such structural rigidity and weather resistance is especially important. Metal panels have been found to be not only resistant to moisture and impact damage, but when properly tuned they have shown the unexpected result of better acoustics and a dramatic improvement in acoustic fidelity over most materials used. The thickness of the face panel 22 or the tuning pad 30 can be between 1/16 of an inch (1.58 mm) to 5/8 of an inch (64 mm) in one range. In one narrower, often preferred range, the face panel 22 may be a thickness of 1/8 of an inch (3.175 mm) to 5/16 of an inch (13 mm). Tests have been successful with a face panel 22 that is 3/16 of an inch thick (4.76 mm).

One problem that can occur with face panels covering a plurality of speaker elements, particularly low frequency speaker elements, is creation of an interference region 100 of the face panel 22. This interference region 100 is caused by a superposition of the oscillations created by the low frequency elements 50A and 50B. This interference region causing an undesired oscillation of the face panel 22, and thus undesired sound emission from the speaker system 20. Such a superposition is affected by the density of the material forming the face panel 22, thus for example a steel face panel will have a different interference region 100, with a different acoustic effect than an expanded PVC panel for example.

Figure 14:
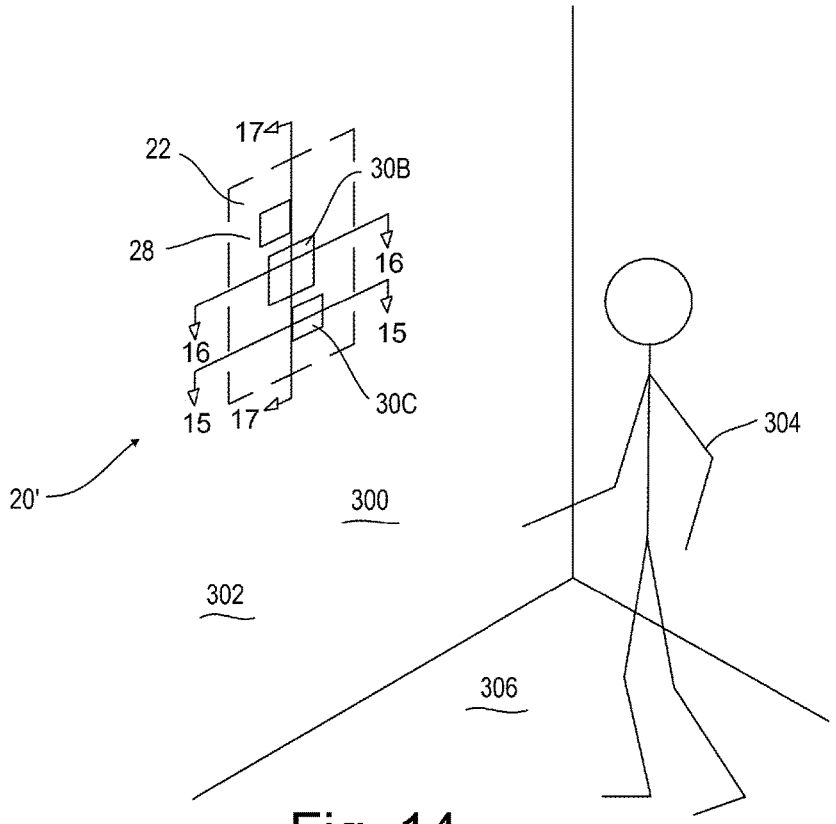
FIG. 14 is an environmental view of an in-the wall hidden example of a speaker system with an acoustically tuned face panel.
Figure 15:
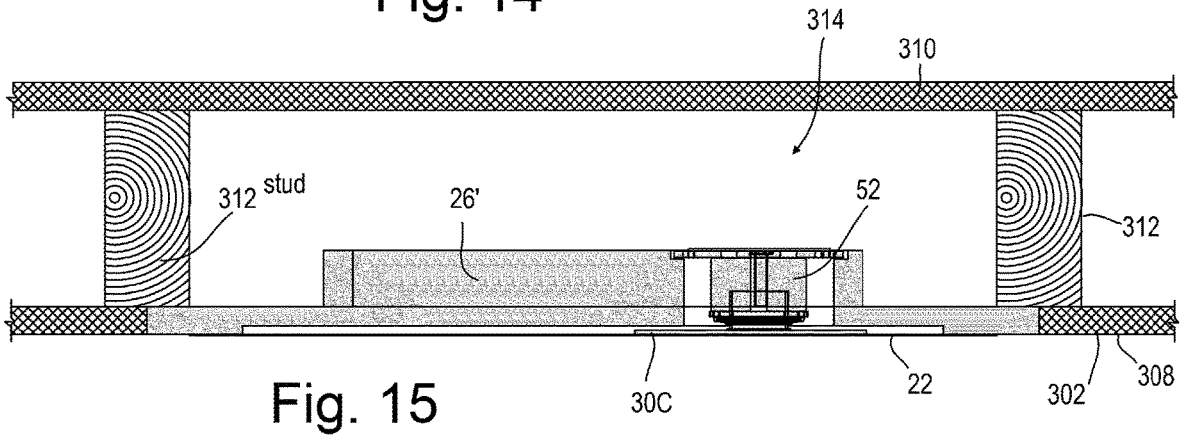
FIG. 15 is a cutaway view taken along line 15-15 of FIG. 14.
Figure 16:
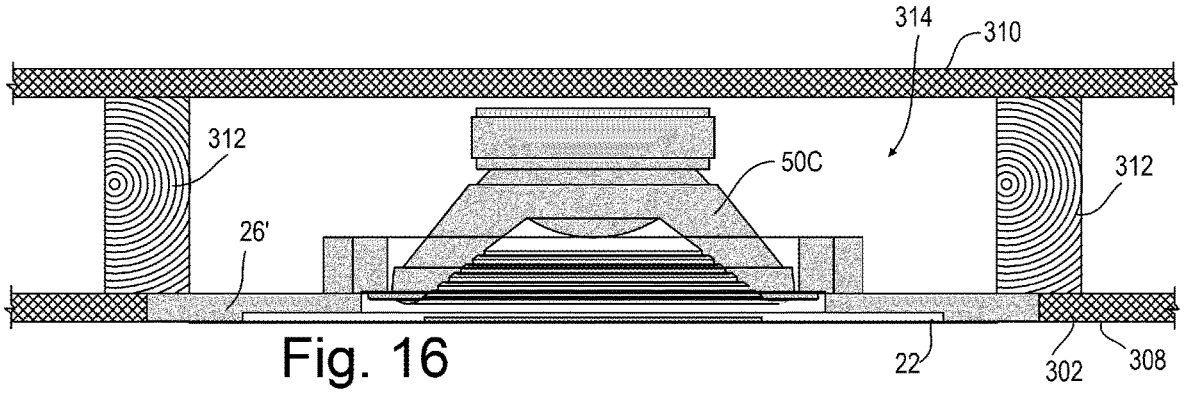
FIG. 16 is a cutaway view taken along line 16-16 of FIG. 14.
Figure 17:
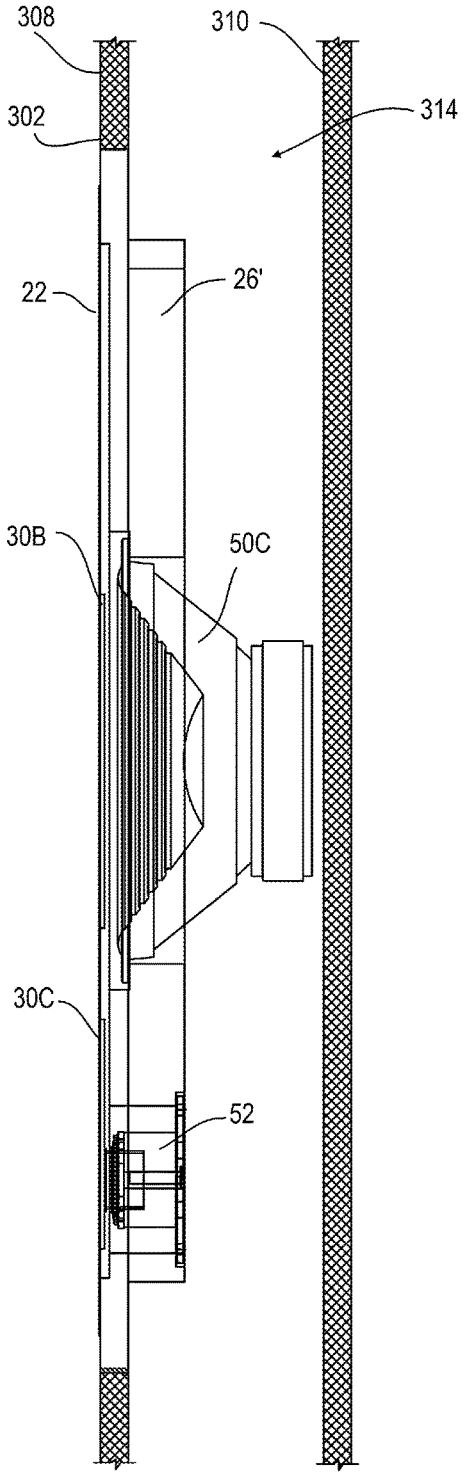
FIG. 17 is a cutaway view taken along line 17-17 of FIG. 14.
Figure 18:
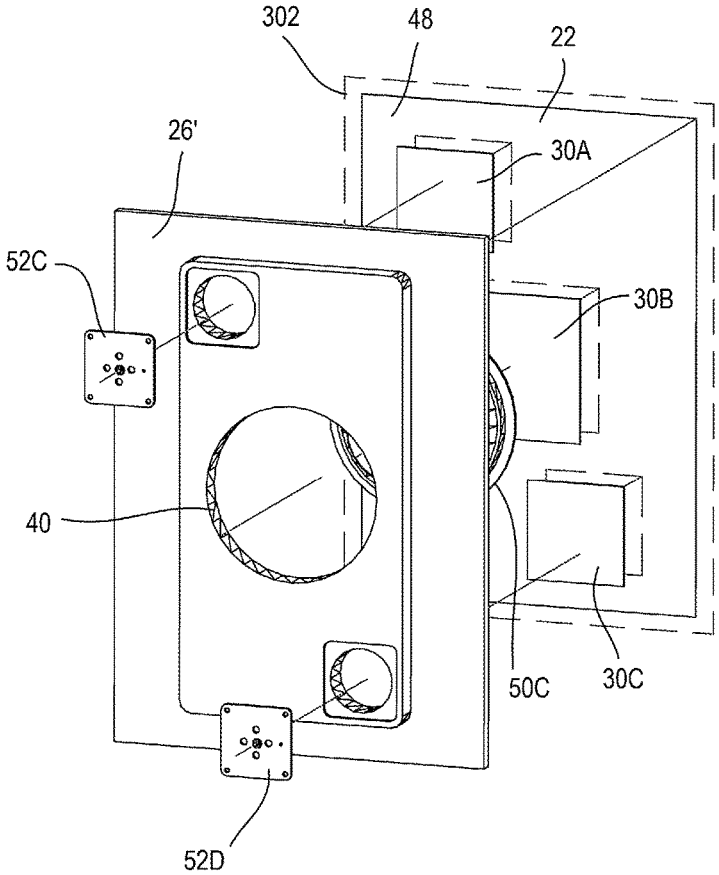
FIG. 18 is a partially exploded rear view of the example shown in FIG. 14 removed from the wall.

Prior art installations include the apparatus disclosed in U.S. Pat. No. 8,611,575 where a cellular structure face panel 22 (426) is used as shown in FIG. 14-15. In some installations using a cellular structure face panel 22 (426) such as expanded PVC or foam cored material, it was known that at higher frequencies the cellular structure may dampen sound transmission therethrough. Thus, a solution was conceived to remove a portion of the face panel 22, forming a recessed portion (467) as shown in FIG. 17 and then placing a high frequency insert (466) into this recess. Thus, high frequency sound transmission would be maintained. Were the high frequency insert (466) simply applied to the surface of the face panel 22 (426), the dampening effect would not be canceled in some installations.

Once the source of the undesired acoustic signal (the interference between adjacent speaker elements) was discovered, a solution was sought. Disclosed herein is an inventive approach to solving the problem of the interference region 100 in many materials. This solution being the attachment of a tuning panel, or pad 30 to the face panel 22. The tuning panel 30 having aspects that allow for particular configuration to a known face panel 22 material, thickness, acoustic range, speaker system 50. These aspects including material, shape, thickness, width, length, corner shape, that allow for particular configuration of the tuning pad 30.

In one example, a single tuning pad 30 extends into adjacent acoustic chambers 32 of adjacent speaker assemblies 24 as shown in FIG. 8-11 where the tuning pad 30 extends into acoustic chambers 32A, 32B. This example is particularly advantageous in tuning the interference region 100.

In some examples as described, the disclosed apparatus can be applied to in-wall systems. Elsewhere, a free-standing system using a free-standing speaker housing may be desired. Looking to FIG. 12 and FIG. 13 is shown a speaker housing 200 comprising one or more speaker systems 20 with an acoustically tuned front panel 22 as disclosed above to form a free-standing device. The housing 200 formed of at least one speaker system 20 (A-E). In one example some of the sides may be formed of other assemblies then the acoustically tuned front panel 22.

In one example, the individual face panels 22 (A-F) having a speaker assembly attached thereto or without, have sealed edges 204, thus forming a sealed or substantially sealed housing 200. In one example, use of rigid metal, metal composites, and metal alloys as the face panels 22 forms a rigid sealed housing 200. Due to the improved rigidity of the current materials, a sealed housing functions well in a temperature changing environment where previous materials often faced deformation due in part to changing internal pressures as the temperature of the gas (air) inside the enclosure changed.

The housing 200 may have a line input port 206 for attachment of cords electrically providing power and/or signal to the speaker drivers there within. In another example, a wireless connection may be used. The power may also be provided as part of the housing 200, such as via batteries, solar, etc.

Looking to FIGS. 14-18 is shown an example of a hidden installation of a speaker system 20. In this example, the speaker system 20 is installed in a wall 300 having a front wall surface 302. In such a hidden installation, the front surface 28 of the face panel 22 is substantially coplanar with the front wall surface 302. Thus, an observer/listener 304 within a room 306 in part defined by the wall 300 will be able to hear sound vibrations from the speaker system 20, while visually unaware of the location of the speaker system 22. This in some applications is used for aesthetic appeal, and in other applications is used for security where the speaker system 22 may be subject to vandalism when its location is identified.

Looking to the example as shown in FIG. 14-15, the wall 300 comprises a front panel 308 and a rear panel offset by a plurality of frame members (studs) 312. This structure forming a cavity 314 into which is placed the speaker assembly 20.

In the specific example shown in FIGS. 14-18, separate tuning pads 30A and 30C are attached to the rear surface 48 of the face panel 22 forward of each high frequency element 52C and 52D. In many installations, it will be desired that these tuning pads 30A and 30B do not directly touch the frame 26 nor any other part of the support structure.

In the specific example shown in FIGS. 14-18, a tuning pad 30B is attached to the rear surface 48 of the face panel 22 forward of the single low frequency element 50C. In many installations, it will be desired that these tuning pads 30A and 30B do not directly touch the frame 26 nor any other part of the support structure.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. An acoustically tuned face panel assembly for a speaker system, the panel assembly comprising:

a base frame having a forward side;

a first speaker assembly fixed to the base frame;

a second speaker assembly fixed to the base frame;

a non-permeable face panel having a rearward side offset from the first speaker assembly and the second speaker assembly;

the rearward side of the face panel in contact with the forward side of the base frame;

a first acoustic chamber defined by the rearward side of the face panel, the first speaker assembly, and a surface defining a first opening through the base frame;

a second acoustic chamber defined by the rearward side of the face panel, the second speaker assembly, and a surface defining a second opening through the base frame; and a tuning pad attached to the rearward side of the face panel wherein the tuning pad extends from the first acoustic chamber to the second acoustic chamber without directly contacting the base frame, the tuning pad configured to reduce interference vibrations in the first acoustic chamber.

2. The panel assembly as recited in claim 1 wherein the face panel comprises a metal sheet.

3. The panel assembly as recited in claim 1 wherein the tuning pad comprises a metal sheet.

4. The panel assembly as recited in claim 1 wherein the tuning pad comprises the same material as the face panel.

5. A sealed housing comprising at least one panel assembly as recited in claim 1 wherein the face panel forms at least one outer surface of the sealed housing.

6. The panel assembly as recited in claim 1 wherein the thickness of the tuning pad is 1/16 of an inch (1.58 mm) to 5/8 of an inch (64 mm).

7. The panel assembly as recited in claim 6 wherein the thickness of the tuning pad is 1/8 of an inch (3.175 mm) to 5/16 of an inch (13 mm).

8. The panel assembly as recited in claim 1 wherein the thickness of the face panel is 1/16 of an inch (1.58 mm) to 5/8 of an inch (64 mm).

9. The panel assembly as recited in claim 8 wherein the thickness of the face panel is 1/8 of an inch (3.175 mm) to 5/16 of an inch (13 mm).

10. The panel assembly as recited in claim 9 wherein the thickness of the face panel is 3/16 of an inch thick (4.76 mm).

* * * * *